US006202616B1

(12) United States Patent
Gracyalny

(10) Patent No.: US 6,202,616 B1
(45) Date of Patent: Mar. 20, 2001

(54) VALVE SEAL ASSEMBLY FOR AN INTERNAL COMBUSTION ENGINE

(75) Inventor: Gary J. Gracyalny, Milwaukee, WI (US)

(73) Assignee: Briggs & Stratton Corporation, Milwaukee, WI (US)

( * ) Notice: Subject to any disclaimer, the term of this patent is extended or adjusted under 35 U.S.C. 154(b) by 0 days.

(21) Appl. No.: 09/251,168

(22) Filed: Feb. 17, 1999

(51) Int. Cl.[7] ..... F02N 3/00
(52) U.S. Cl. ..... 123/188.5; 123/188.6
(58) Field of Search ..... 123/188.5, 188.6, 123/658

(56) References Cited

U.S. PATENT DOCUMENTS 1,586,613 * 6/1926 Disch ..... 123/188.6
2,157,867 * 5/1939 Robertson et al. ..... 123/188.6
2,207,400 * 7/1940 Gass ..... 123/188.6
4,531,483 * 7/1985 Vossieck et al. ..... 123/188.6
4,993,379 * 2/1991 Viazzi ..... 123/188.6
5,174,256 * 12/1992 Binford ..... 123/188.6
5,237,971 * 8/1993 Worsely ..... 123/188.6
5,553,869 * 9/1996 Stamback ..... 123/188.6
5,558,056 * 9/1996 Sakata ..... 123/188.6

* cited by examiner

*Primary Examiner*—Marguerite McMahon
*Assistant Examiner*—Jason Benton
(74) *Attorney, Agent, or Firm*—Michael Best & Friedrich LLP

(57) ABSTRACT

The present invention is a valve seal assembly used to prevent the lubricating fluid used to lubricate a valve stem and valve guide from entering the combustion chamber of an internal combustion engine. The valve seal assembly has an outer side surface that sealingly engages the engine housing of the internal combustion engine. The valve seal assembly is also preferably located near the end of the valve guide that is closest to the combustion chamber. The valve seal assembly also includes a resilient sealing element that has an improved sealing lip for preventing the lubricating fluid from traveling past the sealing lip. The sealing lip is also positioned in order to extend the operating life and effectiveness of the valve seal assembly.

22 Claims, 2 Drawing Sheets

FIG. 1
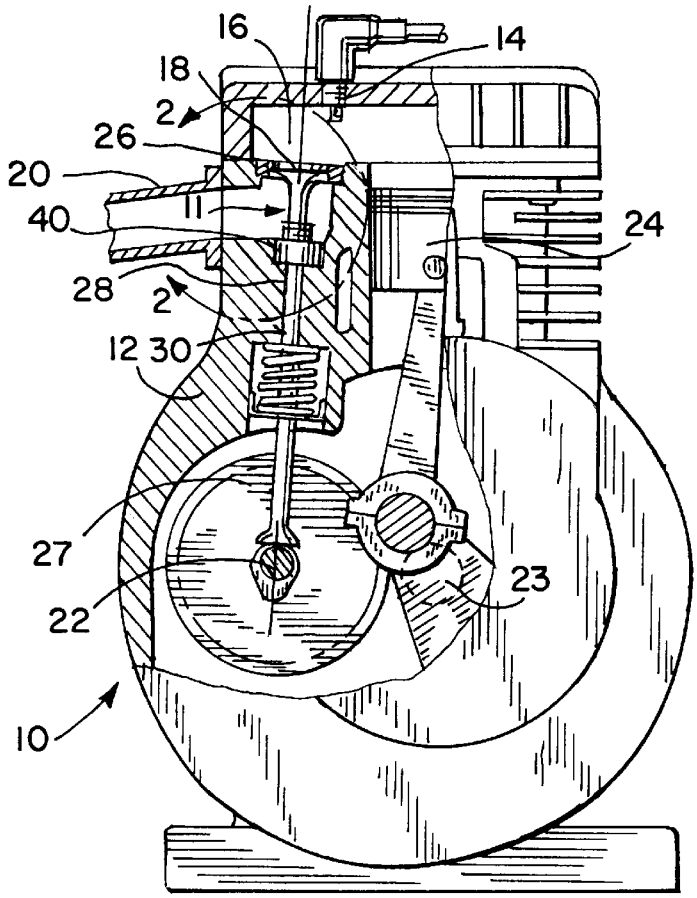
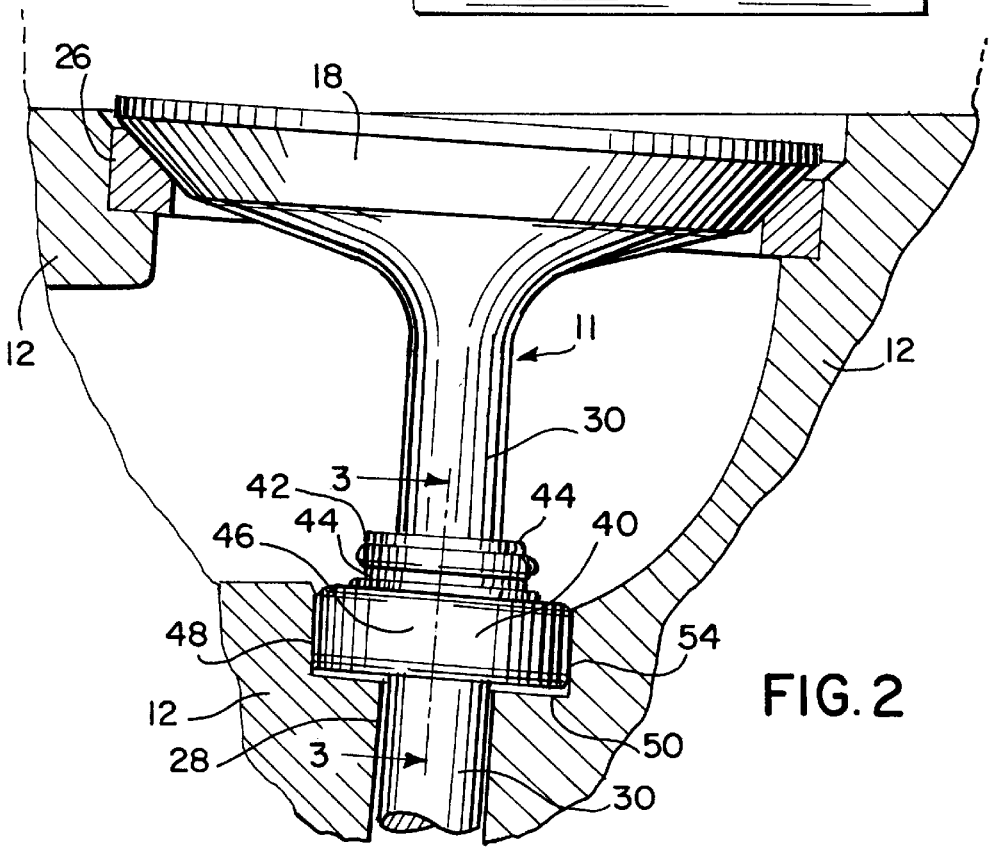
FIG. 2

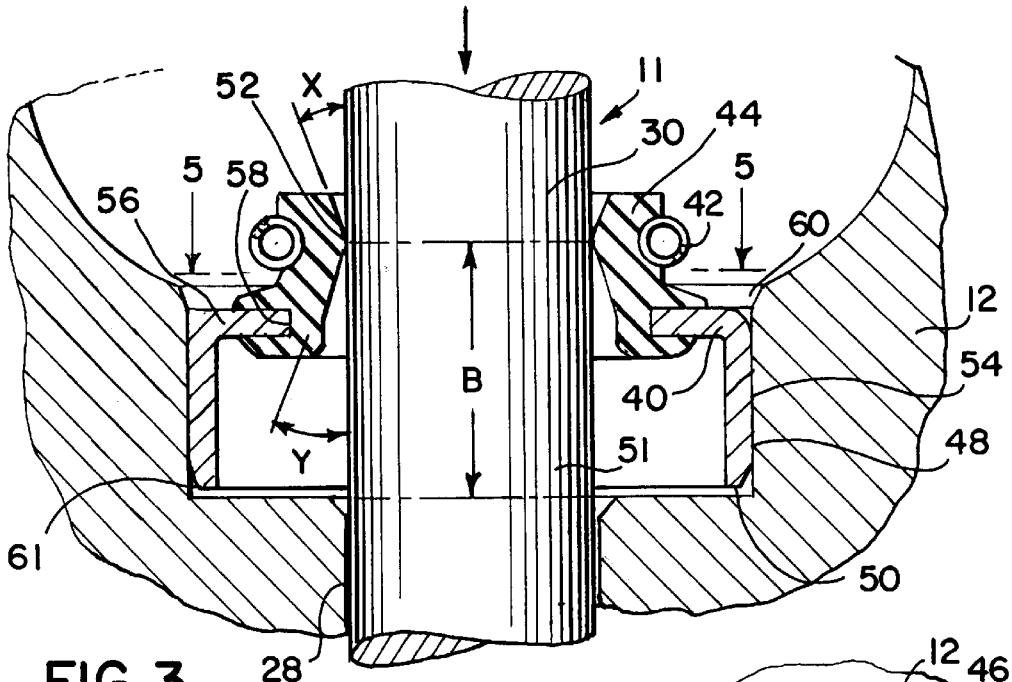
FIG. 3
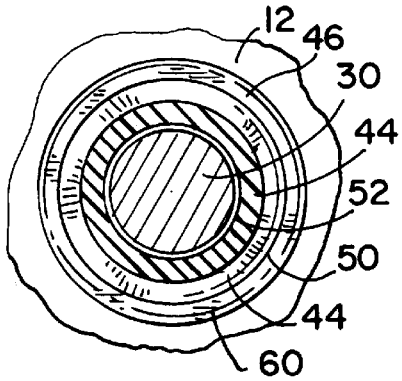
FIG. 5
FIG. 4
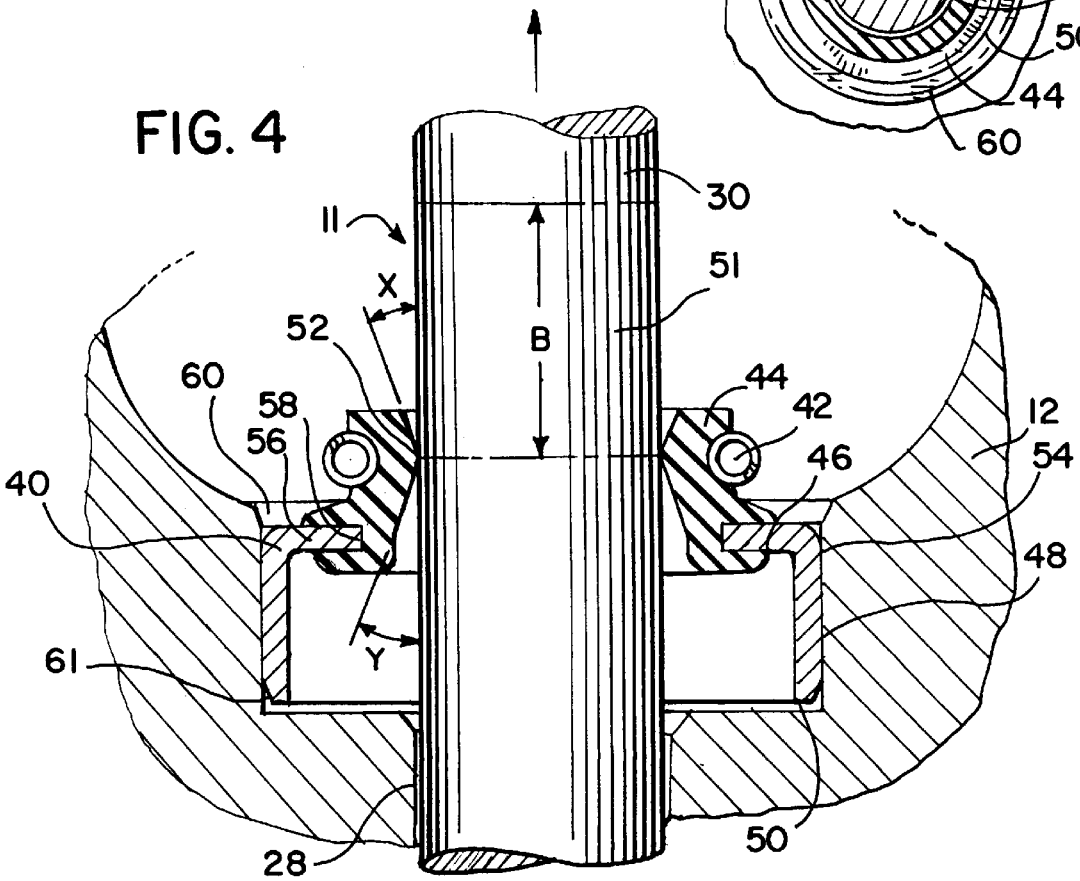

VALVE SEAL ASSEMBLY FOR AN INTERNAL COMBUSTION ENGINE

FIELD OF THE INVENTION

The present invention relates to a valve seal assembly, and more particularly to a valve seal assembly for preventing a lubricating fluid from entering the combustion chamber of an internal combustion engine.

BACKGROUND PRIOR ART

In many countries, governments are requiring manufacturers to reduce the amount of emissions which are expelled from small internal combustion engines. Manufacturers of internal combustion engines are therefore constantly developing new ways to reduce emission levels.

One source of unwanted emissions develops when the fluids, (typically conventional motor oil), that are used to lubricate the valve stems and valve guides within an internal combustion engine escape from the engine. In many engines, the lubricating fluid escapes past the valve seals, through the intake and the exhaust valve guides, and thereafter enters the intake and exhaust manifolds through the valve ports.

The level of unwanted exhaust emissions increases when the lubricating fluid escapes from the exhaust valve guide because the lubricating fluid is then expelled from the engine along with the rest of the emissions. The level of unwanted emissions also increases when the lubricating fluid escapes past the intake valve guide. The lubricating fluid that escapes past the intake valve guide enters the combustion chamber. Since the lubricating fluid is not readily combustible under these conditions it is not completely burned, and as a result the lubricating fluid is expelled from the engine as emissions. Carbon deposits are also formed on and around the intake valve head in addition to the inner surfaces of the internal combustion chamber. These deposits absorb some of the hydrocarbons contained within the air/fuel mixture that is input into the combustion chamber. The hydrocarbons are absorbed into the deposits during the compression stroke of the engine, causing the absorbed hydrocarbons to escape combustion. The absorbed hydrocarbons are then released during the exhaust stroke, resulting in increased levels of unwanted emissions.

Valve seal assemblies are commonly installed on the cylinder head in an engine having an overhead-valve configuration, and in the engine block on an engine having a side valve configuration. The valve seal assemblies are usually located on the end of the valve guide that is farthest from the combustion chamber. Conventional valve seal assemblies also include a resilient seal element that is compressed against the valve stem in order to prevent most of the lubricating fluid from travelling past the sealing element.

Valve seal assemblies are commonly installed over protruding portions of valve guide inserts. Conventional valve seal assemblies are also inserted into counterbores. The valve seal assemblies typically include a bottom surface that is sealingly engaged with the bottom surface of the counterbore. The bottom surface of the counterbore does not provide a sufficiently smooth finish capable of satisfactorily sealing the valve seal assembly with the counterbore due to the presence of jagged cutters on the cutting tool used to create the bottom surface of the counterbore.

One drawback associated with using known valve seal assemblies is the design of the lips in the sealing elements.

Conventional lip designs typically allow some lubricant to leak past because the seal assembly is located on the end of the valve guide which is farthest from the combustion chamber. The valve seal assembly must allow some amount of lubricant to leak past the sealing element or the valve stem and valve guide will not receive any lubricant. Once the lubricant enters the valve guide it can travel along the length of the valve stem and valve guide until it enters the valve port. As stated previously, when the lubricating fluid passes through the valve ports, the level of unwanted emissions increases.

Another drawback of known valve seal assemblies is that the seal element is positioned too close to the valve guide. During operation of the engine, the valve stem of the valve becomes damaged with notches and burrs as it reciprocates within the valve guide. When the notches and burrs travel back and forth across a lip on the sealing element, the lip is damaged resulting in reduced operating life and effectiveness of the valve seal assembly.

SUMMARY OF THE INVENTION

The present invention is embodied in a valve seal assembly used to prevent the fluid used to lubricate a valve stem and a valve guide in an internal combustion engine from entering the combustion chamber of the engine. The valve seal assembly has an outer side surface that is sealingly engaged with an engine housing. The valve seal assembly may also include a resilient sealing element that has an improved sealing lip. The improved sealing lip is sealingly engaged with the valve stem in order to prevent the lubricating fluid from escaping past the sealing lip. The sealing lip is also positioned relative to the valve guide in order to extend the operating life and effectiveness of the sealing element. The valve seal assembly of the present invention comprises a shell and the resilient sealing element. The shell preferably includes a retainer wall that extends inwardly from a first end of the shell. The resilient sealing element is disposed within an opening in the retainer wall, preferably by engaging a notch in the sealing element with an edge in the opening of the retainer wall. The shell is preferably a cylindrical shell.

The sealing element further includes an improved sealing lip that is sealingly engaged with the valve stem. The sealing lip is located axially outside of the shell adjacent to the first end. The sealing lip extends from the valve stem (i) toward the shell, preferably at an angle between 30° and 90° relative to the valve stem, and (ii) away from the shell, preferably at an angle between 10° and 60° relative to the valve stem. A ring-shaped spring may also be disposed about the sealing element to compress the sealing lip against the valve stem.

The present invention has another aspect in that the valve seal assembly may be part of an apparatus that substantially prevents lubricating fluid from escaping an engine housing. The apparatus includes the valve seal assembly, an engine housing, and a guide disposed about the valve stem within the engine housing. The guide directs the reciprocating movement of the valve stem along a longitudinal axis of the valve stem. The valve seal assembly is preferably disposed near the end of the valve guide that is closest to the combustion chamber (i.e., the port side). Locating the valve seal assembly near the end of the valve guide closest to the combustion chamber substantially prevents the lubricating fluid from entering the valve ports yet allows complete lubrication of the valve stem and valve guide.

The valve seal assembly may also include a shell that has an outer side surface adapted to be sealed against an engine housing. The outer side surface is preferably sealed by a press fit, against a machined (i.e., substantially smooth) surface on the engine housing. Even more preferably, the machined surface of the engine housing is an inner side surface of a counterbore that has been machined into the engine housing. The inner side surface of a counterbore is substantially smooth when machined by known cutting techniques. This substantially smooth inner side surface provides an effective seal in conjunction with the outer side surface of the shell when the shell is pressed or disposed in the counterbore.

Another aspect of the present invention pertains to the location of the sealing lip on the valve seal assembly. The sealing lip is sealingly engaged with the valve stem and is positioned such that no substantial part of the valve stem which reciprocates within the guide touches the lip. Locating the lip of the sealing element in this manner serves to prevent the sealing lip from being harmed by any significant portion of the valve stem that might have been damaged as a result of the reciprocating movement within the valve guide. Since only undamaged (i.e., smooth) sections of the valve stem contact the sealing lip, the amount of harm done to the sealing element is minimized. Minimizing harm to the sealing lip increases the expected operating life and effectiveness of the sealing element.

Other features and advantages of the invention will become apparent to those skilled in the art upon review of the following detailed description and claims.

Before some of the aspects of the invention are explained in detail, it is to be understood that the invention is not limited in its application to the aspects set forth in the application. The invention is also capable of other aspects, either alone or in combination. Also, it is understood that the phraseology and terminology used herein are for the purpose of description and not should be regarded as limiting.

BRIEF DESCRIPTION OF THE DRAWINGS

FIG. 1 is a partially sectioned side view of an internal combustion engine having a side valve configuration.

FIG. 2 is an enlarged section view of the internal combustion engine of FIG. 1 taken from the line 2—2 of FIG. 1.

FIG. 3 is a section view of the valve seal assembly of FIGS. 1 and 2 taken along the line 3—3 of FIG. 2, depicted when the valve is substantially closed.

FIG. 4 is a section view similar to that as shown in FIG. 3 depicted when the valve is substantially open.

FIG. 5 is a cross-sectional view of the valve seal assembly of FIGS. 1–4 taken along line 5—5 in FIG. 3.

DETAILED DESCRIPTION OF THE INVENTION

FIG. 1 is a partially sectioned side view of an internal combustion engine. In FIG. 1, an internal combustion engine 10 has an intake valve 11 that is situated within an engine housing 12. Valve 11 may be either an intake or an exhaust valve. The internal combustion engine 10 further includes a spark plug 14 located adjacent to a combustion chamber 16. The combustion chamber 16 is in fluid flow communication with a valve port 26, and the valve port 26 is in fluid flow communication with an intake manifold 20.

Valve 11 includes a valve stem 30 and a valve head 18. The valve head 18 is shown in a substantially closed positioned within the valve port 26.

During operation of the engine shown in FIG. 1, a mixture of fuel and air is drawn through the intake manifold 20 into the combustion chamber 16 through valve port 26. The air/fuel mixture is ignited within the combustion chamber 16 by the spark plug 14 when the intake and exhaust valves are in substantially closed positions within their respective valve ports. The combustion that occurs within combustion chamber 16 powers a reciprocating piston 24 and through means not described herein (but commonly known in the art) a cam shaft 22 is driven by rotating a crankshaft 23. The forced rotation of the cam shaft 22 causes the valve 11 to axially reciprocate within engine housing 12. The valve 11 reciprocates between a closed position (which is when combustion takes place), and an open position. When the exhaust valve opens, any emissions which are remaining within combustion chamber 16 after combustion has occurred exit through the exhaust valve port and into an exhaust manifold.

The valve 11 is positioned within a valve guide 28 in the engine housing 12. The valve guide 28 directs the reciprocating movement of the valve stem 30 along the longitudinal axis 27 of the valve 11. A fluid, typically conventional motor oil, is used within the valve guide 28 to reduce friction between the valve stem 30 and the valve guide 28. As used herein, "engine housing" means those portions of the engine that enclose the reciprocating and rotating engine components, and at least include the crankcase, cylinder bore, cylinder head and, as stated previously, the valve guide 28.

The present invention is a valve seal assembly 40 that is used to prevent the lubricating fluid from entering the combustion chamber 16. The valve seal assembly 40 is preferably positioned near or on the end of the valve guide 28 that is closest to the combustion chamber 16.

FIG. 2 is an enlarged section view taken from the area 2—2 of FIG. 1. In FIG. 2, valve seal assembly 40 is shown in greater detail. The valve seal assembly 40 includes a sealing element 44 that is sealingly engaged with a shell 46. A ring-shaped spring 42 may be disposed about the sealing element 44 to provide an additional compressive force to facilitate sealing the sealing element 42 against the valve stem 30.

The shell 46 is preferably pressed into a counterbore 50 that has been machined into the engine housing 12. When the shell 46 is pressed into the counterbore 50, an outer surface 48 of the shell 46 is sealingly engaged with an inner side surface 54 of the counterbore 50.

FIGS. 3–5 are additional section views of the valve seal assembly of FIGS. 1 and 2. The shell 46 of valve seal assembly 40 preferably includes an inwardly extending retainer wall 56. The retainer wall 56 supports the sealing element 44. The sealing element 44 can be molded directly to the shell 46, or the sealing element 44 could include a notch 58 that fits within an opening in the retainer wall 56 (as shown in FIGS. 3 and 4).

Sealing element 44 further includes a sealing lip 52 that sealingly engages the valve stem 30. The sealing lip 52 may be located axially outside of the shell 46 adjacent to the retainer wall 56. The sealing lip 52 extends from the valve stem 30 toward the shell 46 at an angle Y relative to the valve stem 30. Angle Y is preferably between 30 and 90°. The sealing lip 52 also extends from the valve stem 30 away from the shell 46 at an angle X relative to the valve stem 30. Angle X is preferably between 10° and 60°. Angle Y should be larger than angle X in order to prevent the lubricating fluid from extending past the sealing lip 52 into the valve port 26.

As previously discussed, and shown most clearly in FIGS. 3 and 4, the present invention may include a ring-shaped spring 42 disposed about the sealing element 44. The ring-shaped spring 42 is preferably located in close proximity to the sealing lip 52 in order to increase the compressive force exerted on the sealing lip 52 by the ring-shaped spring 42. The added compressive force improves the sealing engagement between the sealing lip 52 and the valve stem 30.

Shell 46 is preferably substantially cylindrical (see FIG. 5) in order to facilitate sealing the outer side surface 48 against the inner side surface 54 of the counterbore 50 when the shell 46 is press-fit into the counterbore 50, although other shapes may be used. As shown most clearly in FIGS. 3 and 4, a chamfered edge 60 may be included at the entry to counterbore 50 in order to facilitate the insertion of the valve seal assembly 40 into the counterbore 50. In addition, shell 46 may also include a chamfered edge 61 to further facilitate insertion of the valve seal assembly 40.

As previously discussed, during operation of the internal combustion engine 10, the valve 11 reciprocates within the valve guide 28 along the longitudinal axis 27 of the valve 11. The length of this reciprocating movement, or stroke, is shown in FIGS. 3 and 4 as dimension B. The sealing lip 52 is preferably located such that no part of the valve stem 30 which reciprocates within the valve guide 28 also contacts the sealing lip 52. As shown most clearly in FIGS. 3 and 4, the section 51 of the valve stem 30 (illustrated in FIGS. 3 and 4 as stroke dimension B) that reciprocates across the sealing lip 52 does not touch the valve guide 28.

Although it is preferred that no part of the stroke section 51 touch the valve guide 28, the valve seal assembly 40 of the present invention may also be designed such that a small portion of the section 51 which reciprocates across the sealing lip 52 also reciprocate within the valve guide 28 without departing from the scope of the present invention.

Alternative aspects of the present invention will be apparent to those skilled in the art and are within the intended scope of the present invention.

What is claimed is:

1. A valve seal assembly for sealing a valve stem and a valve guide in an internal combustion engine, said valve seal assembly comprising:

a shell having a first end; and a resilient sealing element sealingly engaged with said shell, said sealing element including a lip located axially outside of said shell adjacent to said first end, wherein said lip is adapted to be sealingly engaged with the valve stem, said lip extends from the valve stem toward said shell at a first acute angle relative to the valve stem and extends from the valve stem away from said shell at a second acute angle relative to the valve stem, wherein said first acute angle is larger than said second acute angle.

2. The valve seal assembly of claim 1 wherein said shell includes a radially inwardly extending retainer wall at said first end of said shell, said retainer wall including an opening having an edge, and wherein said sealing element being disposed within said opening.

3. The valve seal assembly of claim 2 wherein said sealing element includes a notch that engages said edge in said retainer wall.

4. The valve seal assembly of claim 1 further comprising a ring-shaped spring disposed about said sealing element that compresses said lip against the valve stem.

5. The valve seal assembly of claim 1 wherein said first acute angle is between 30 and 90 degrees and said second acute angle is between 10 and 60 degrees.

6. The valve seal assembly of claim 1 wherein said shell is substantially cylindrical.

7. An apparatus that seals a reciprocating valve stem in an internal combustion engine, comprising:

an engine housing;

a guide disposed about the valve stem within said engine housing for guiding the valve stem movement along a longitudinal axis of the valve stem; and a valve seal assembly sealingly engaged with the valve stem, said valve seal assembly comprising a shell having an outer side surface sealed against said engine housing.

8. The apparatus of claim 7 wherein said valve seal assembly includes a resilient sealing element that sealingly engages said shell, said sealing element including a lip that sealingly engages with the valve stem.

9. The apparatus of claim 7 wherein said engine housing includes a counterbore having an inner side surface that is sealed against said outer side surface of said shell.

10. The apparatus of claim 9 wherein said shell is substantially cylindrical.

11. An apparatus that seals a reciprocating valve stem in an internal combustion engine, comprising:

an engine housing;

a guide disposed about the valve stem within said engine housing for guiding the valve stem movement along a longitudinal axis of the valve stem; and a valve seal assembly having a resilient sealing element, said sealing element including a lip that is sealingly engaged with the valve stem such that no substantial part of the valve stem which moves within said guide touches said lip.

12. The apparatus of claim 11 wherein no part of the valve stem which moves within said guide touches said lip.

13. The apparatus of claim 11 wherein said valve seal assembly further includes a shell having a first end, and wherein said shell includes a radially inwardly extending retainer wall at the first end of said shell, said retainer wall including an opening adapted to receive said sealing element.

14. The apparatus of claim 13 wherein said lip is located outside of said shell adjacent to said first end.

15. An apparatus that seals a reciprocating valve stem in an internal combustion engine, comprising:

an engine housing;

a guide disposed about the valve stem within said engine housing for guiding the valve stem movement along a longitudinal axis of the valve stem;

a valve seal assembly comprising;

a shell having a first end and an outer side surface, wherein said outer side surface is sealed against said engine housing; and a resilient sealing element sealingly engaged with said shell, said sealing element includes a lip located axially outside said shell adjacent to said first end, said lip is sealingly engaged with the valve stem such that substantially no part of the valve stem which moves within said guide touches said lip, said lip extends from the valve stem toward said shell at a first acute angle relative to the valve stem and extends from the valve stem away from said shell at a second acute angle relative to the valve stem, wherein said first acute angle is larger than said second acute angle.

16. The apparatus of claim 15 wherein said first acute angle is between 30 and 90 degrees and said second acute angle is between 10 and 60 degrees.

17. The apparatus of claim 15 wherein said engine housing includes a counterbore having an inner side surface that is sealed against said outer side surface.

18. The apparatus of claim 15 further comprising a ring-shaped spring disposed about said sealing element for compressing said lip against the valve stem.

19. The apparatus of claim 15 wherein the valve seal assembly is located on an end of said guide that is closest to a combustion chamber in the internal combustion engine.

20. An apparatus that seals a reciprocating valve stem in an internal combustion engine, comprising:

an engine housing;

a guide disposed about the valve stem within said engine housing for guiding the valve stem movement along a longitudinal axis of the valve stem; and a valve seal assembly sealingly engaged with the valve stem, said valve seal assembly comprising a shell and a resilient sealing element sealingly engaged with said shell, said sealing element including a lip that is sealingly engaged with the valve stem and extends from the valve stem toward said shell at a first acute angle relative to the valve stem and extends from the valve stem away from said shell at a second acute angle relative to the valve stem, wherein said first acute angle is larger than said second acute angle, said valve seal assembly being located near an end of said guide that is closest to a combustion chamber in the internal combustion engine.

21. The apparatus of claim 20 wherein said first acute angle is between 30° and 90° and said second acute angle is between 10° and 60°.

22. The apparatus of claim 20 wherein said shell includes an outer side surface being sealed against an inner side surface of a counterbore in said engine housing.

* * * * *